US011220388B2

(12) United States Patent
Klatt

(10) Patent No.: US 11,220,388 B2
(45) Date of Patent: Jan. 11, 2022

(54) TRANSPORT AND STORAGE CONTAINER FOR LIQUIDS

(71) Applicant: PROTECHNA S.A., Fribourg (CH)

(72) Inventor: Bernd Klatt, Ruppach-Goldhausen (DE)

(73) Assignee: PROTECHNA S.A., Fribourg (CH)

( * ) Notice: Subject to any disclaimer, the term of this patent is extended or adjusted under 35 U.S.C. 154(b) by 0 days.

(21) Appl. No.: 17/059,671

(22) PCT Filed: May 20, 2019

(86) PCT No.: PCT/EP2019/062931
§ 371 (c)(1),
(2) Date: Nov. 30, 2020

(87) PCT Pub. No.: WO2019/228839
PCT Pub. Date: Dec. 5, 2019

(65) Prior Publication Data

US 2021/0221592 A1 Jul. 22, 2021

(30) Foreign Application Priority Data

Jun. 1, 2018 (DE) ..... 10 2018 113 115.1

(51) Int. Cl.
*B65D 77/04* (2006.01)
*B65D 77/06* (2006.01)

(52) U.S. Cl.
CPC ..... *B65D 77/0466* (2013.01); *B65D 77/061* (2013.01); *B65D 2519/00024* (2013.01); *B65D 2519/00034* (2013.01)

(58) Field of Classification Search
CPC .... B65D 77/04; B65D 77/0466; B65D 77/06; B65D 77/061; B65D 2519/00024; B65D 2519/00034
USPC ..... 206/386
See application file for complete search history.

(56) References Cited

U.S. PATENT DOCUMENTS 4,909,387 A * 3/1990 Schutz ..... B65D 77/0466 206/386
5,645,185 A * 7/1997 Cassina ..... B65D 77/0466 220/1.5
6,857,532 B2 2/2005 Przytulla
(Continued)

FOREIGN PATENT DOCUMENTS

EP 2604545 A1 6/2013

*Primary Examiner* — Bryon P Gehman
(74) *Attorney, Agent, or Firm* — Dickinson Wright PLLC; Andrew D. Dorisio

(57) ABSTRACT

A transport and storage container (10) for liquids comprising a pallet-type understructure (29) for a plastic inner container (11) and a cage (22) having horizontal bars (23) and vertical bars (24) made of metal for housing the inner container, lower ends (27) of the vertical bars having a connecting portion (40), which is formed by deformation and has a trough-shaped recess (43), for being welded to a lower edge profile of the cage (22), wherein, to define a bending portion (58), the vertical bars (24) have another trough-shaped recess (59), which is disposed adjacent to the connecting portion (40) and which has a recess opening (60) formed on the inside (32) of the vertical bars (24), which faces the inner container (11), and a trough bottom (62) formed by a flattened portion of the hollow profile (45).

5 Claims, 5 Drawing Sheets

(56) References Cited

U.S. PATENT DOCUMENTS

| | | | | |
|---|---|---|---|---|
| 7,036,662 | B2 * | 5/2006 | Schutz | B65D 77/0466 206/386 |
| 9,004,310 | B2 * | 4/2015 | Schutz | B65D 77/0466 206/386 |

* cited by examiner

Fig. 3
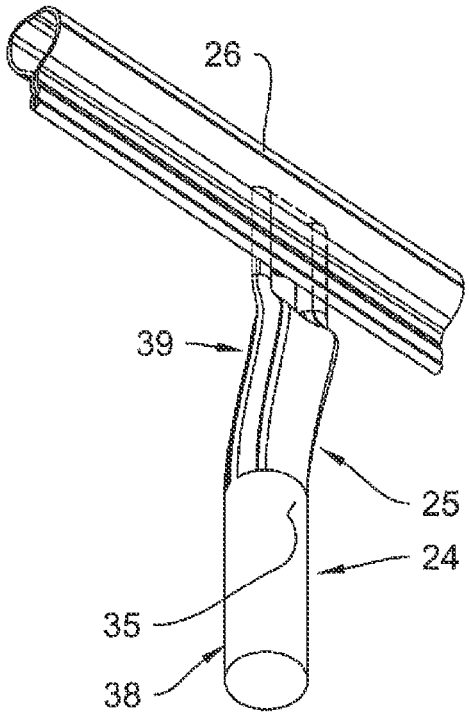
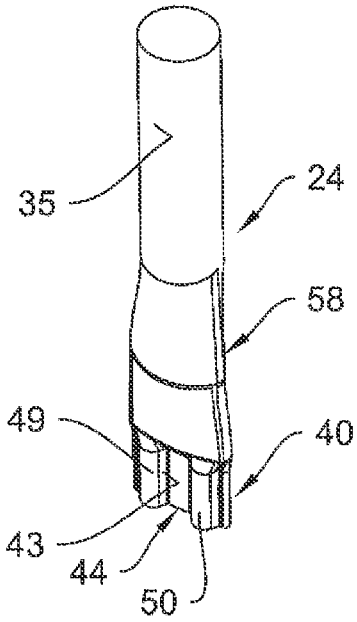
Fig. 6

Fig. 5
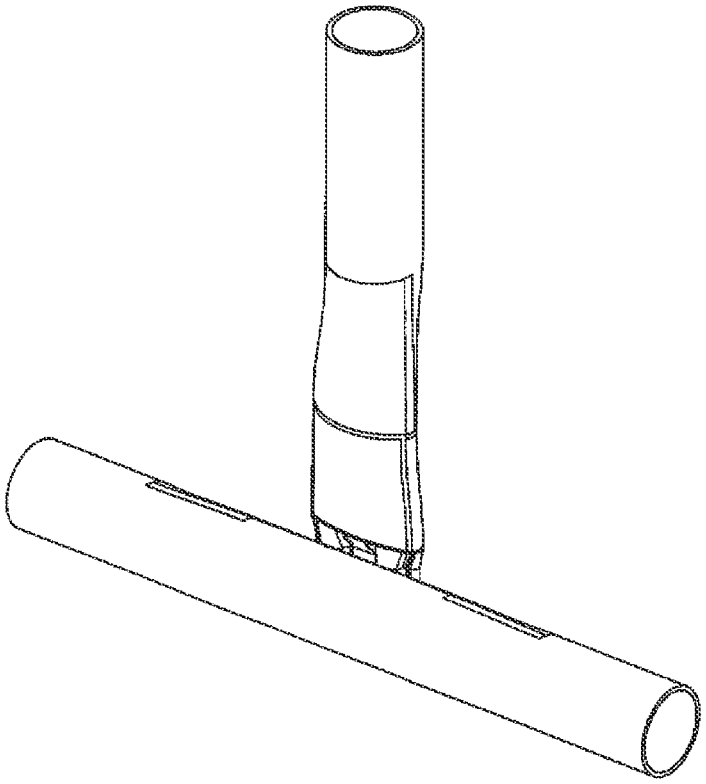
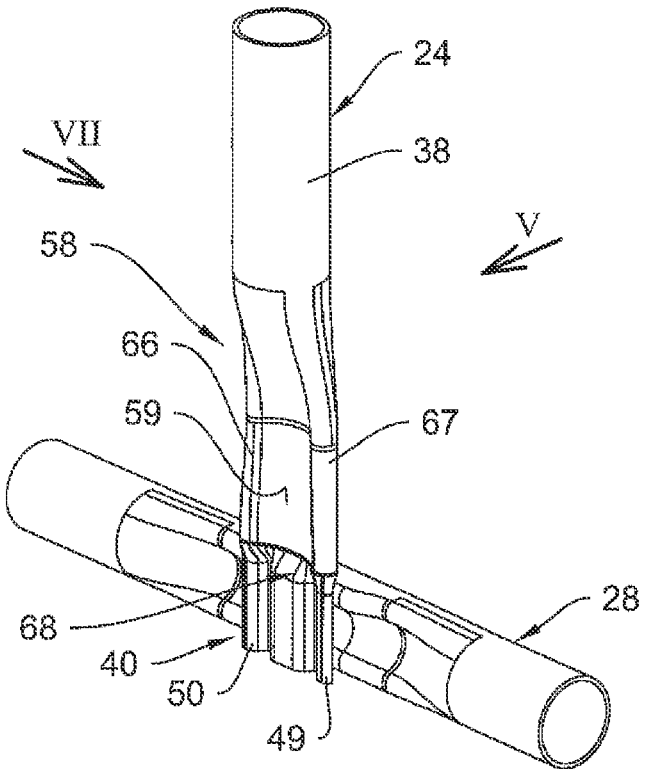
Fig. 4

Fig. 8
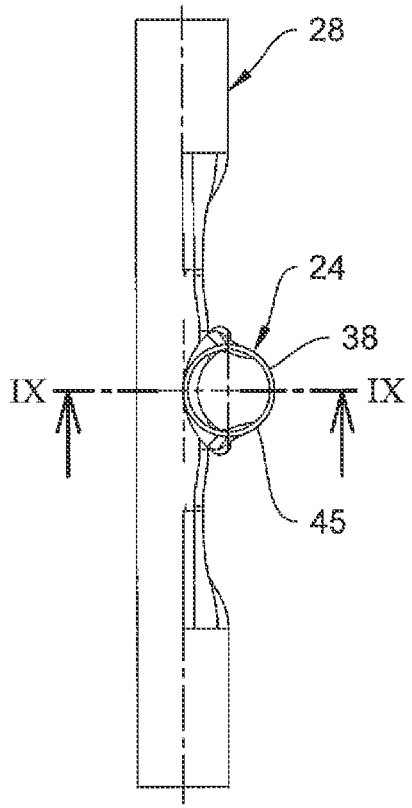
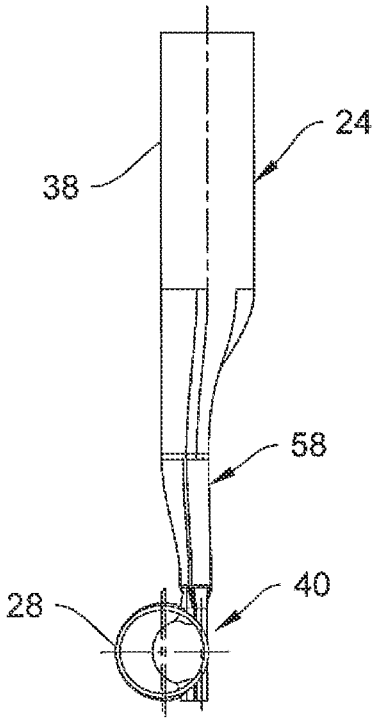
Fig. 7
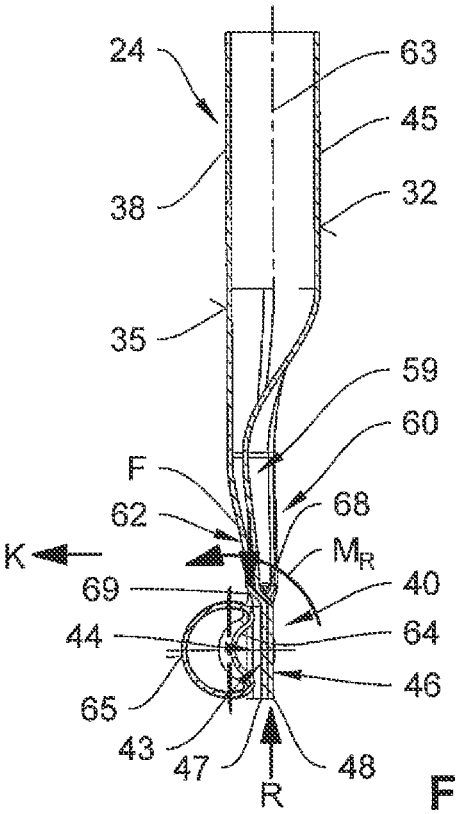
Fig. 9

TRANSPORT AND STORAGE CONTAINER FOR LIQUIDS

FIELD OF THE INVENTION

The present invention relates to a transport and storage container for liquids comprising a pallet-type understructure for a plastic inner container and a cage having horizontal bars and vertical bars made of metal for housing the inner container, ends of the vertical bars, which are hollow profiles, being welded to lower and upper circumferential edge profiles of the cage, at least the lower ends of the vertical bars having a connecting portion with a connecting cross-section formed by deformation for being welded to the lower edge profile, the connecting portion having a trough-shaped recess with a recess opening formed on the outside of the vertical bars, which faces away from the inner container, and a trough bottom formed by a flattened portion of the hollow profile, the recess opening being limited by two edge webs which extend in the direction of the longitudinal bar axis of the vertical bars and which serve to form a welded connection with the lower edge profile.

BACKGROUND OF THE INVENTION

Transport and storage containers of the kind mentioned above are used to transport and store liquids which are often classified as hazardous materials, which is why the transport and storage containers have to fulfil special requirements in terms of safe transport and safe storage of the liquids. In particular, measures have to be taken that will prevent a cage deformed or destroyed by external forces from perforating the plastic inner container in case the transport and storage container becomes damaged, which would allow hazardous materials to escape from the inner container into the environment.

Hence, it is known for particularly sensitive areas of the inner container, such as the lower corner portions of the inner container, to be provided with additional corner reinforcements which are shell-shaped and disposed in the corner portions between the cage and the inner container and, thus, are supposed to prevent a cage deformed in the respective areas from directly affecting the inner container.

SUMMARY OF THE INVENTION

The object of the present invention is to propose a transport and storage container that offers increased protection against damage of the inner container in the lower corner portions of the transport and storage container without using any additional corner reinforcements.

To attain said object, the transport and storage container according to the invention has the features disclosed herein.

According to the invention, the vertical bars have an additional recess adjacent to the connecting portion in order to define a bending portion, said additional recess having a recess opening formed on the inside of the vertical bars, which faces the inner container, and a trough bottom formed by a flattened portion of the hollow profile.

Drop tests performed with conventional transport and storage containers have shown that a bending point is defined above the connecting portion because the connecting portion is designed with a flattened cross-section in such a manner that a recess that has two edge webs extending in the longitudinal direction of the vertical bar and serving to form a welded connection with the lower edge profile is disposed on the side facing away from the inner container. Upon impact of the transport and storage container with the understructure, which leads to bending especially of vertical bars disposed in the corner portion of the cage in the direction of the inner container, the inner container is often damaged by a bending vertical bar. So far, such damages to the inner container were effectively prevented only by the corner reinforcements mentioned above.

Since the transport and storage container is provided with a bending portion designed according to the invention and disposed adjacent to the connecting portion in such a manner that the bending portion has an additional recess, which is disposed on the side of the vertical bar that faces the inner container, a pressure force generated in the vertical bar causes the vertical bar to bend in a direction away from the inner container. The inversely disposed recesses—the recess for forming the connecting portion being disposed on the side facing away from the inner container and the recess of the bending portion being disposed on the side of the vertical bar facing the inner container—allow a force flow to be formed in the vertical bar, said force flow enabling the generation of a bending moment composed of a weight and a reaction force and having a defined effective direction upon impact of the transport and storage container if the vertical bars are substantially straight.

Thus, the design of the transport and storage container according to the invention allows the known corner reinforcements to be omitted without any impact on the external dimensions of the transport and storage container.

Particularly advantageously, the recess of the bending portion is realized as a dent which extends in the direction of the longitudinal bar axis of the vertical bars and which has edges formed as edge webs and extending in the direction of the longitudinal bar axis of the vertical bars, which means that the cross-sectional geometry of the edge webs, which is material to the bending stiffness, can be easily determined through the depth of the dent impressed into the vertical bars to form the bending portion.

Preferably, the recesses in the connecting portion and in the bending portion have edge webs of different lengths, the edge webs formed in the bending portion particularly preferably having a greater edge web length than the edge webs of the connecting portion, meaning that the edge web length in the bending portion can be selected in particular according to the desired deformation behavior in the bending portion.

If a transitional portion formed between the connecting portion and the bending portion forms a profile ramp in the area of transition from the recess of the connecting portion to the recess of the bending portion in a longitudinal section extending along the longitudinal bar axis, this may also influence the deformation behavior of the vertical bars in the bending portion in a specific way. Depending on how the transitional portion is designed, i.e. depending in particular on the contour or the length of the profile ramp, the bending portion can be formed closely adjacent or more remotely adjacent to the connecting portion, but above the connecting portion in either case.

BRIEF DESCRIPTION OF THE DRAWING FIGURES

Hereinafter, a preferred embodiment of the invention will be explained in more detail with the aid of the drawing.

FIG. 3 shows the upper end of the vertical bar as illustrated in FIG. 2;

FIG. 4 shows the lower end of the vertical bar as illustrated in FIG. 2;

FIG. 5 shows the lower end of the vertical bar as illustrated in FIG. 4 according to view V in FIG. 4;

FIG. 6 shows an isolated illustration of the lower end of the vertical bar as illustrated in FIG. 2;

FIG. 7 shows the lower end of the vertical bar as illustrated in FIG. 4 according to view VII;

FIG. 8 shows a top view of the lower end of the vertical bar as illustrated in FIG. 4;

FIG. 9 shows a section view of the vertical bar illustrated in FIG. 8 according to section line IX-IX.

DETAILED DESCRIPTION OF THE INVENTION

Figure 1:
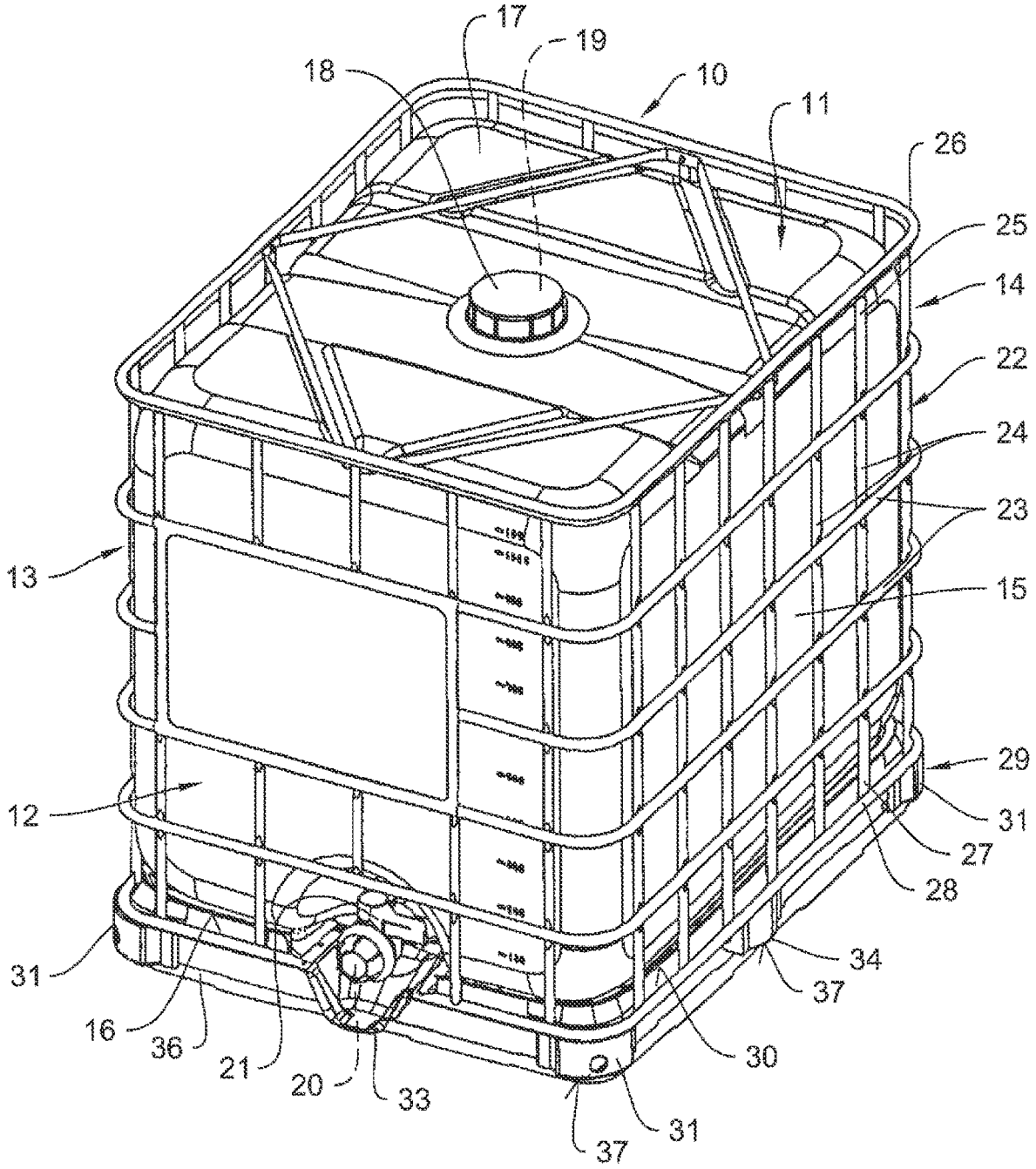
FIG. 1 shows a perspective illustration of a transport and storage container comprising a cage which has upper and lower edge profiles connected to vertical bars.

FIG. 1 shows a transport and storage container 10 for liquids usable as a disposable or reusable container, said transport and storage container 10 comprising a plastic inner container 11 having four side walls 12, 13, 14 and 15 and lower and upper bottoms 16, 17, a filling nick 19 molded to the upper bottom 17 and closable with a lid 18, a tapping neck 20 molded to a lower portion of the side wall and having a tapping armature 21, and an outer cage 22 composed of crossing horizontal bars 23 and vertical bars 24 made of metal for housing the inner container 11. The upper ends 25 of the vertical bars 24 are welded to an upper edge profile 26 and the lower ends 27 are welded to a lower edge profile 28 of the cage 22. Moreover, the cage 22 is connected to a pallet-type understructure 29 via its lower edge profile 28.

The pallet-type understructure 29 has a bottom 30, on which the inner container 11 is arranged and which is disposed on corner legs 31, a rear middle leg (not shown), a front middle leg 33 integrally emerging from the bottom 30, and two lateral middle legs 34. In the case at hand, the corner legs 31 and the middle legs 33, 34 are disposed on a base frame 36 of the pallet-type understructure 29 in such a manner that they protrude outward beyond the base frame 36 by stacking protrusions 37 which are disposed or formed in such a manner that multiple transport and storage containers 10 can be arranged one on top of the other in a stack (not shown), the stacking protrusions 37 of the corner legs 31 and of the middle legs 33, 34 of the upper transport and storage container 10 resting on the upper edge profile 26 of the cage 22 of the lower transport and storage container.

Figure 2:
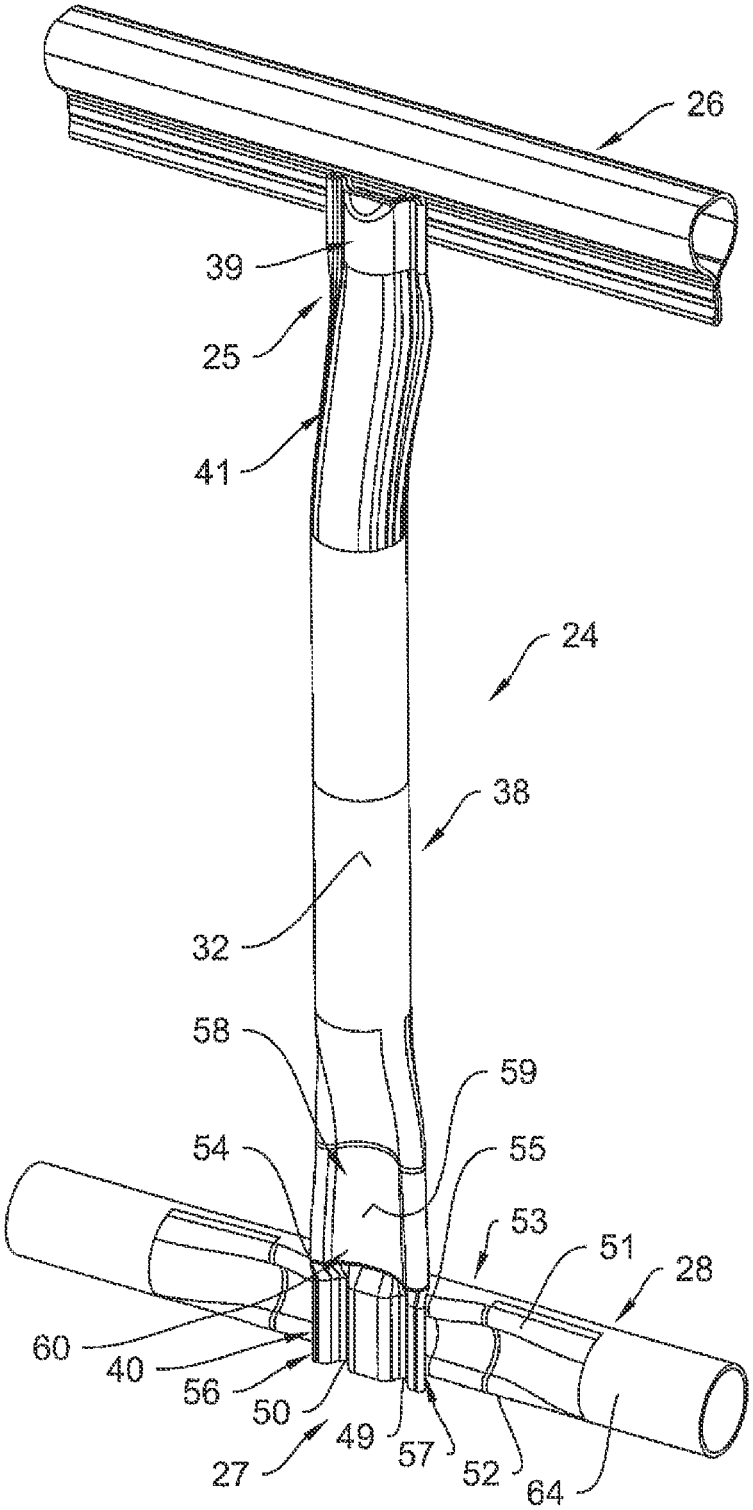
FIG. 2 shows a vertical bar which has an upper connecting portion for connection with an upper edge profile of the cage at its upper end and a lower connecting portion for connection with a lower edge profile of the cage at its lower end.

FIG. 2 shows a vertical bar 24 with the differing upper and lower ends 25, 27, which are connected to each other via a substantially straight longitudinal portion 38. Both the upper end 25 and the lower end 27 have a flattened connecting portion 39, 40 for being connected to the upper edge profile 26 and to the lower edge profile 28 of the cage 22, respectively.

As can be seen from a combined view of FIGS. 2 and 3 in particular, the connecting portion 39 is connected to the longitudinal portion 38 via an arc portion 41 at the upper end 25 of the vertical bar 24, the arc portion 41 being provided with a groove-shaped recess 43 on the outside 35 of the vertical bar 24, which faces away from the inner container 11, said recess 43 extending from the connecting portion 39 across the arc portion 41 into the longitudinal portion 38.

As becomes clear from a combined view of FIGS. 2, 6 and 9 regarding the lower connecting portion 40 in particular, both the upper connection portion 39, which is illustrated in FIG. 3, and the lower connecting portion 40, which is illustrated in FIG. 4, have a trough-shaped recess 43 which has a recess opening 44 formed on the outside 35, which faces away from the inner container, and a trough bottom 46 formed by a flattened portion of a hollow profile 45 (FIG. 8) forming the vertical bar 24. In the embodiment illustrated in FIG. 9, the flattened portion is designed in such a manner that opposing wall portions 47, 48 of the outside 35 and of the inside 32 of the hollow profile 45 (FIG. 8) are in contact with each other.

As becomes clear from a combined view of FIGS. 6 and 9 in particular, the trough-shaped recess 43 formed in the connecting portion 40 serves to form two edge webs 49, 50, which extend in the direction of a longitudinal bar axis 63 of the vertical bar 24 and which, in order to form a welded connection to the lower edge profile 28 as illustrated in FIG. 2, are disposed relative to mutually parallel edge webs 51, 52 of a connecting portion 53 of the lower edge profile 28 in such a manner that a total of four contact points 54 to 57 at which the connecting portions 40, 53 are spot-welded to each other form between the edge webs 49, 50 of the connecting portion 40 of the vertical bar 24 and the edge webs 51, 52 of the connecting portion 53 of the lower edge profile 28.

As becomes clear from a combined view of FIGS. 2, 7 and 9 in particular, a bending portion 58 is disposed adjacent to the connecting portion 40 of the vertical bar 24, said bending portion 58 having a trough-shaped recess 59 which, as opposed to the trough-shaped recess 43 of the connecting portion 40, is disposed in such a manner that a recess opening 60 is formed on the inside 32 of the vertical bar 24, which faces the inner container 11, which means that a trough bottom 62 formed by a flattened portion of the hollow profile 45 is offset toward the outside 35 of the vertical bar 24 relative to trough bottom 46.

The forces acting in the event of pressure on the vertical bar 24, i.e. a pressure force F and a corresponding reaction force R, are marked in FIG. 9 to illustrate the effect of the trough-shaped recesses 43 and 59, which are thus formed inversely at the lower end of the vertical cage bar 24 and whose respective recess openings 44, 60 face in different directions, namely away from the inner container 11 in the case of recess opening 44 and toward the inner container 11 in the case of recess opening 60. As a result of the inverse disposition of the recesses 43 and 49, the trough bottoms 46, 62 are disposed in such a manner that, as illustrated in FIG. 9, a reaction moment $M_R$, which rotates left in the configuration illustrated in FIG. 8, is generated at the lower end 27 of the vertical bar 24 in the area of transition from the bending portion to the connecting portion 40, said reaction moment $M_R$ causing the vertical bar 24 to bend outward in direction K away from the inner container 11 in the area of the bending portion 58. Thus, damage to the inner container by deformation of the vertical bar 24 occurring in the area of the lower end 27 can essentially be precluded.

As can also be seen from the illustration in FIG. 9, since the trough-shaped recesses 43, 59 are disposed inversely at the lower end 27 of the vertical bar 24 in such a manner that the recess opening 44 of the recess 43 formed in the connecting portion 40 faces away from the inner container 11 and the recess opening 60 of the trough-shaped recess 59 formed in the bending portion 58 faces toward the inner container 11, a welded connection can be formed between the connecting portion 40 of the vertical bar 24 and the connecting portion 53 of the lower edge profiles 28 on an inside 64 of the lower edge profile 28, which faces the inner container 11, on the one hand, and that a deformation of the vertical cage bar 24 due to pressure, i.e. a load that is typical for an impact of the transport and storage container 10 in case of a drop from a container stack or from a means of transport, in the area of the bending portion 58 occurs toward the outside 65 of the edge profile 28, i.e. away from the inner container 11, on the other hand.

As becomes clear from FIG. 4 in particular, the recess 59 of the bending portion 58 is realized as a spoon-shaped dent which extends in the direction of the longitudinal bar axis 63 of the vertical bar 24 and which has edges realized as edge webs 66, 67 and extending in the direction of the longitudinal bar axis 63. As can also be seen from FIG. 4, the edge webs 66, 67 of the bending portion 58 have a substantially greater length than the edge webs 49, 50 of the connecting portion 40 and continuously merge with the longitudinal portion 38 of the cage bar 24 owing to the dent-shaped design of the recess 59, which means that the bending behavior, i.e. the way in which the vertical cage bar 24 deforms in the area of the bending portion 58, can be set through the length of the edge webs 66, 67 and through the design of their cross-sectional profile.

In order to be able to largely preclude component failure or brakeage of the cage bar 24 in the immediate area of transition from the bending portion 28 to the connecting portion 40 when the cage bar 24 bends outward in the bending portion 58, a transitional portion 68 (FIG. 9) is formed between the connecting portion 40 and the bending portion 58, said transitional portion 68 being designed as a profile ramp 69 in a longitudinal section extending along the longitudinal bar axis 63, said profile ramp 69 allowing a continuous transition between the trough bottoms 46, 62 of the recesses 43, 59 formed adjacent to each other.

The invention claimed is:

1. A transport and storage container (10) for liquids comprising:

a pallet understructure (29) adapted for receiving a plastic inner container (11); and a cage (22) having horizontal bars (23) and vertical bars (24) made of metal adapted for housing the inner container at least partially within the cage, wherein an upper end (25) and a lower end (27) of the vertical bars (24) each define a longitudinal bar axis (63) and each have a hollow profile (45), wherein the upper end (25) and the lower end (27) of the vertical bars are welded to an upper circumferential edge profile (26) and a lower circumferential edge profile (28), respectively, of the cage, wherein the lower ends (27) of the vertical bars each have a connecting portion (40), which is formed by deformation, said connecting portion (40) being welded to the lower circumferential edge profile, wherein the connecting portion includes a first trough-shaped recess (43) with a first recess opening (44) formed on an outside (35) of the vertical bars (24), which faces away from the inner container (11), and a first trough bottom (46) formed by a flattened portion of the hollow profile of the lower end of a respective one of the vertical bars, wherein the first recess opening (44) is bordered by two edge webs (49, 50) extending in the direction of the longitudinal bar axis (63) of a respective one of the vertical bars, wherein each of said two edge webs is welded to the lower circumferential edge profile (28), wherein the vertical bars (24) further define a bending portion (58), the bending portion including a second trough-shaped recess (59) adjacent to the connecting portion (40), the second trough-shaped recess (59) including a recess opening (60) formed on an inside (32) of the vertical bars (24), which faces the inner container (11), and a second trough bottom (62) formed by a flattened portion of the hollow profile (45) of the lower end of a respective one of the vertical bars.

2. The transport and storage container according to claim 1, wherein the second trough-shaped recess (59) of the bending portion (58) is formed as a spoon-shaped dent which extends in the direction of the longitudinal bar axis (63) of the respective one of the vertical bars (24) and which has edges formed as second edge webs (66, 67) and extending in the direction of the longitudinal bar axis (63) of the respective one of the vertical bars (24).

3. The transport and storage container according to claim 1, wherein the recesses (43, 59) in the connecting portion (40) and in the bending portion (58) have edge webs (49, 50; 66, 67) of different lengths.

4. The transport and storage container according to claim 3, wherein the second edge webs (66, 67) formed in the bending portion (58) have a greater length than the edge webs (49, 50) of the connecting portion (40).

5. The transport and storage container according to claim 1, wherein a transitional portion (68) formed between the connecting portion (40) and the bending portion (58) forms a profile ramp (69) in the area of transition from the recess (43) of the connecting portion (40) to the second trough-shaped recess (59) of the bending portion (58) in a longitudinal section extending along the longitudinal bar axis (63) of the respective one of the vertical bars.

* * * * *